US008854211B2

(12) United States Patent
Kim

(10) Patent No.: US 8,854,211 B2
(45) Date of Patent: Oct. 7, 2014

(54) INTEGRATED CIRCUIT CARD SYSTEM AND A DATA TRANSMISSION METHOD THEREOF

(75) Inventor: Ki Hong Kim, Suwon-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1203 days.

(21) Appl. No.: 12/718,051

(22) Filed: Mar. 5, 2010

(65) Prior Publication Data

US 2010/0245048 A1 Sep. 30, 2010

(30) Foreign Application Priority Data

Mar. 31, 2009 (KR) ..... 10-2009-0027716

(51) Int. Cl.
*G08B 13/14* (2006.01)
*G08C 19/02* (2006.01)

(52) U.S. Cl.
CPC ..... *G08C 19/02* (2013.01)
USPC ..... 340/572.1; 340/10.1; 340/10.4; 235/375; 235/385; 710/11; 710/60

(58) Field of Classification Search
None
See application file for complete search history.

(56) References Cited

U.S. PATENT DOCUMENTS

| | | | | |
|---|---|---|---|---|
| 5,850,187 | A * | 12/1998 | Carrender et al. | 340/10.6 |
| 5,940,006 | A * | 8/1999 | MacLellan et al. | 370/314 |
| 7,061,459 | B2 | 6/2006 | Koizumi | |
| 2003/0164811 | A1 | 9/2003 | Kim et al. | |
| 2004/0019844 | A1 * | 1/2004 | Goodnow et al. | 714/798 |
| 2004/0049616 | A1 * | 3/2004 | Dunstan et al. | 710/100 |
| 2006/0002483 | A1 | 1/2006 | Kim | |
| 2006/0020371 | A1 * | 1/2006 | Ham et al. | 700/266 |
| 2008/0001667 | A1 * | 1/2008 | Yang et al. | 330/260 |
| 2008/0237355 | A1 * | 10/2008 | Ahn et al. | 235/492 |
| 2008/0320187 | A1 * | 12/2008 | Kim et al. | 710/100 |
| 2009/0134212 | A1 * | 5/2009 | Chamley et al. | 235/375 |
| 2009/0157928 | A1 * | 6/2009 | Riegebauer | 710/110 |
| 2009/0252068 | A1 * | 10/2009 | Charles et al. | 370/276 |
| 2010/0175067 | A1 * | 7/2010 | Appe et al. | 718/103 |
| 2010/0277104 | A1 * | 11/2010 | Lin et al. | 315/312 |

FOREIGN PATENT DOCUMENTS

| | | |
|---|---|---|
| JP | 2006-146885 | 6/2006 |
| KR | 1020030069783 | 8/2003 |
| KR | 1020060002517 | 1/2006 |

* cited by examiner

*Primary Examiner* — Curtis King
(74) *Attorney, Agent, or Firm* — F. Chau & Associates, LLC

(57) ABSTRACT

An integrated circuit card system that includes a radio frequency (RF) integrated circuit configured to wirelessly communicate with an integrated circuit card reader; and an integrated circuit card, which is connected to the RF integrated circuit by a single wire, the integrated circuit card configured to change an amount of current of a data signal output from the integrated circuit card according to a transmission speed of a data signal input to the integrated circuit card from the RF integrated circuit.

15 Claims, 7 Drawing Sheets

INTEGRATED CIRCUIT CARD SYSTEM AND A DATA TRANSMISSION METHOD THEREOF

CROSS-REFERENCE TO RELATED APPLICATION

This U.S. non-provisional patent application claims priority under 35 U.S.C. §119 to Korean Patent Application No. 10-2009-0027716, filed on Mar. 31, 2009, the disclosure of which is incorporated by reference herein in its entirety.

BACKGROUND

1. Technical Field

The present inventive concept relates to integrated circuits, and more particularly, to a single wire protocol (SWP) compliant integrated circuit card that controls an amount of current of an output data signal according to a transmission speed of an input data signal.

2. Discussion of Related Art

Integrated circuit (IC) cards are plastic cards including an IC chip (or IC) capable of performing specific transactions. The IC chip has a microprocessor, card operating system, security module, memory, etc. IC cards are also called smart cards.

An IC card may be connected to a host or a reader in a wired or wireless fashion and may employ a single wire protocol (SWP). The SWP is applied when the integrated circuit card is connected to an external host using one wire. This link is a point-to-point transmission line between a contact on the integrated circuit card and a contact on the host. The SWP supports high data transmission speeds, for example, 100 Kbps-1.6 Mbps, and facilitates full duplex communication.

High speed data transfers, however, increase the amount of current consumed by the integrated circuit card and can lead to data transmission errors. Accordingly, there is a need to provide an integrated circuit card that can stably operate during high speed operations.

SUMMARY

An exemplary embodiment of the inventive concept provides a transmission method that may include receiving a first data signal transmitted in accordance with a single wire protocol; determining a transmission speed of the first data signal; and outputting a second data signal in accordance with the single wire protocol, wherein an amount of current of the second data signal is changed according to the transmission speed of the first data signal.

Determining the transmission speed of the first data signal may include detecting a first edge of the first data signal to generate a first edge detection signal; beginning a clock cycle count in response to the first edge detection signal; detecting a second edge of the first data signal to generate a second edge detection signal, the second edge corresponding to the same transition as the first edge; and ending the clock cycle count in response to the second edge detection signal to output the count.

Changing the amount of current of the second data signal may include receiving the count and increasing the amount of current of the second data signal in response to the count being less than a predetermined value or decreasing the amount of current of the second data signal in response to the count being not less than the predetermined value.

An exemplary embodiment of the inventive concept provides an integrated circuit card system that may include a radio frequency (RF) integrated circuit configured to wirelessly communicate with an integrated circuit card reader; and an integrated circuit card connected to the RF integrated circuit by a single wire, the integrated circuit card configured to change an amount of current of a data signal output from the integrated circuit card according to a transmission speed of a data signal input to the integrated circuit card from the RF integrated circuit.

The integrated circuit card may include a transmission speed calculator configured to determine the transmission speed of the input data signal; a current driver configured to provide the current corresponding to the output data signal; a transistor connected between the current driver and a ground voltage, the transistor configured to be controlled by the output data signal, wherein the transmission speed calculator is configured to control the current provided by the current driver according to the transmission speed of the input data signal.

The transmission speed calculator may include a clock generator configured to generate a clock; an edge detector configured to detect first and second edges of the input data signal, the second edge corresponding to the same transition as the first edge; a counter configured to begin counting a cycle of the clock in response to the detection of the first edge, and end the clock cycle counting in response to the detection of the second edge and output the count; and a calculator configured to generate a signal to control the current provided by the current driver according to the count.

The integrated circuit card may further include a plurality of pads, wherein at least one of the pads is connected to the RF integrated circuit by the single wire.

The plurality of pads may include eight pads.

The current driver may include a plurality of switches, each switch serially connected between an input terminal of the integrated circuit card and a respective current source, the current sources connected to an output terminal of the integrated circuit card, and the switches configured to be activated in response to the signal generated by the calculator.

The first and second edges of the input data signal may include rising edges of the input data signal or falling edges of the input data signal.

The input signal and the output signal are transmitted between the RF integrated circuit and the integrated circuit card according to a single wire protocol.

The RF integrated circuit may include an antenna for wirelessly communicating with the integrated circuit card reader.

The input data signal may include data '1' in response to a high voltage level of the input data signal being longer than a low voltage level of the input data signal during a period of the input data signal.

The input data signal may include data '0' in response to a high voltage level of the input data signal being shorter than a low voltage level of the input data signal during a period of the input data signal.

The output data signal may include data '1' in response to the amount of current being equal to or greater than a predetermined value.

The output data signal may include data '0' in response to the amount of current being less than a predetermined value.

The integrated circuit card may be included in a subscriber identification module (SIM) card.

The RF integrated circuit may be included in a SIM card.

The RF integrated circuit and the integrated circuit card may be part of a mobile system.

An exemplary embodiment of the inventive concept provides a radio frequency identification (RFID) system that includes an RFID reader configured to read data from an RFID tag. The RFID reader includes an RF integrated circuit configured to wirelessly communicate with the RFID tag; and an integrated circuit card connected to the RF integrated circuit by a single wire, the integrated circuit card configured to change an amount of current of a data signal output from the integrated circuit card according to a transmission speed of a data signal input to the integrated circuit card from the RF integrated circuit.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
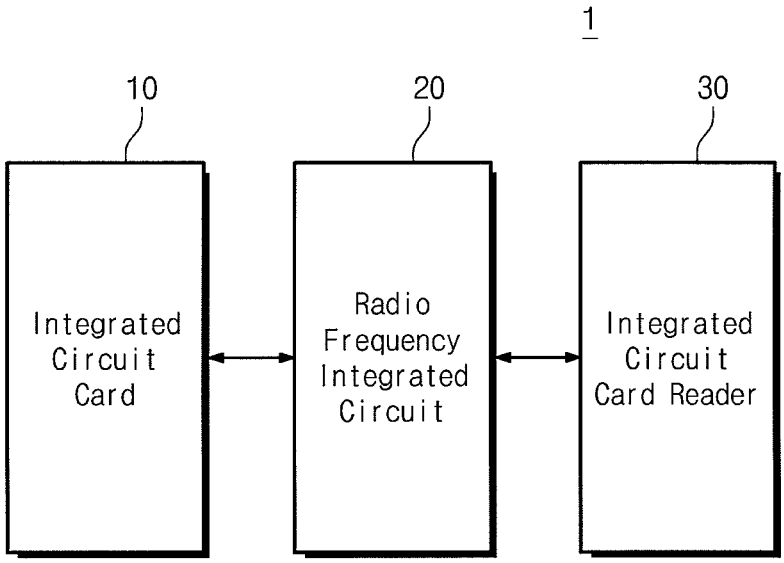
FIG. 1 is a block diagram illustrating a system including an integrated circuit card in accordance with an exemplary embodiment of the inventive concept and a card reader connected to the integrated circuit card.

Exemplary embodiments of the inventive concept will be described below in more detail with reference to the accompanying drawings. The inventive concept may, however, be embodied in many different forms and should not be construed as limited to the embodiments set forth herein. Like reference numerals refer to like elements throughout the specification and drawings.

FIG. 1 is a block diagram illustrating a system 1 including an integrated circuit card in accordance with an exemplary embodiment of the inventive concept and a card reader connected to the integrated circuit card.

Referring to FIG. 1, the system 1 in accordance with an exemplary embodiment of the inventive concept includes an integrated circuit card 10, a radio frequency (RF) integrated circuit 20 and an integrated circuit card reader 30.

The integrated circuit card 10 communicates with the RF integrated circuit 20 through a wire according to a single wire protocol (SWP). The RF integrated circuit 20 wirelessly communicates with the integrated circuit card reader 30. In other words, the integrated circuit card 10 wirelessly communicates with the integrated circuit card reader 30 through the RF integrated circuit 20. The integrated circuit card 10 may also communicate with the integrated circuit card reader 30 through a wire connected to one of eight external pads.

The integrated circuit card 10 and the RF integrated circuit 20 may be provided together as a single product. The integrated circuit card 10 and the RF integrated circuit 20 are described further with reference to FIG. 2.

Figure 2:
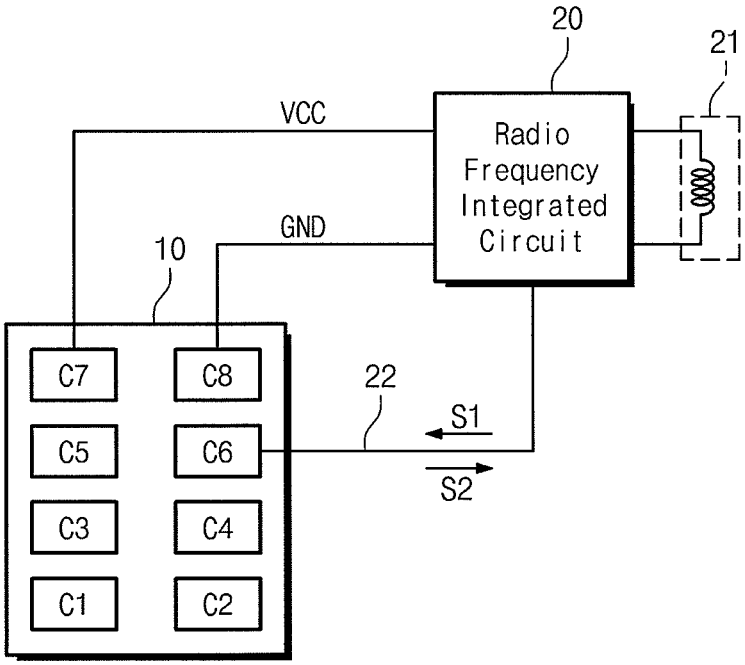
FIG. 2 is a block diagram illustrating the integrated circuit card and a radio frequency (RF) integrated circuit illustrated in FIG. 1.

FIG. 2 is a block diagram illustrating the integrated circuit card 10 and the RF integrated circuit 20 illustrated in FIG. 1.

Referring to FIGS. 1 and 2, the integrated circuit card 10 includes eight pads (C1-C8). The integrated circuit card 10 may be directly connected to the integrated circuit card reader 30 using a portion of the eight pads (C1-C8).

In addition, as illustrated in FIG. 2, the integrated circuit card 10 may wirelessly communicate with the integrated circuit card reader 30 through the RF integrated circuit 20 connected to the pad (C6).

The RF integrated circuit 20 includes an antenna 21 to wirelessly communicate with the integrated circuit card reader 30. The RF integrated circuit 20 can wirelessly communicate with the integrated circuit card reader 30 through the antenna 21.

The RF integrated circuit 20 transmits a power supply voltage (VCC) induced from the integrated circuit card reader 30 to the integrated circuit card 10 through the pad (C7). The RF integrated circuit 20 also transmits a ground voltage (GND) induced from the integrated circuit card reader 30 to the integrated circuit card 10 through the pad (C8).

The integrated circuit card 10 is connected to the RF integrated circuit 20 through a single wire 22. The single wire 22 is connected to the pad (C6) of the integrated circuit card 10. The integrated circuit card 10 transmits and receives data through the single wire 22 in accordance with the SWP. Since the SWP supports full duplex operation, the integrated circuit card 10 can concurrently receive and transmit data. The integrated circuit card 10 in accordance with an exemplary embodiment of the inventive concept is described further with reference to FIG. 4.

A data signal which the integrated circuit card reader 30 transmits to the integrated circuit card 10 through the RF integrated circuit 20 is referred to as S1. A data signal which the integrated circuit card 10 transmits to the integrated circuit card reader 30 through the RF integrated circuit 20 is referred to as S2. The S1 and S2 signals are generated according to the SWP. The S1 and S2 signals are described further with reference to FIG. 3.

The SWP is used for communication between the integrated circuit card 10 and the RF integrated circuit 20. When power that is supplied from the RF integrated circuit 20 to the integrated circuit card 10 is sufficient or power is independently and sufficiently supplied to the integrated circuit card 10, the integrated circuit card 10 can wirelessly communicate with the integrated circuit card reader 30 at a speed of 1.6 Mbps, for example. However, when power that is supplied from the RF integrated circuit 20 to the integrated circuit card 10 is insufficient, the integrated circuit card 10 reduces power consumption to perform a stable operation.

The integrated circuit card 10 senses a transmission speed of the S1 input signal sent in accordance with the SWP. If the transmission speed is high (e.g., 1.6 Mbps), the integrated circuit card 10 increases the amount of current of the signal S2 and, if not, the integrated circuit card 10 reduces the amount of current of the signal S2, thereby providing stable communication. An operation where the integrated circuit card 10 increases or reduces the amount of current of the signal S2 according to the transmission speed of the signal S1 is described further with reference to FIGS. 3 to 7.

Figure 3:
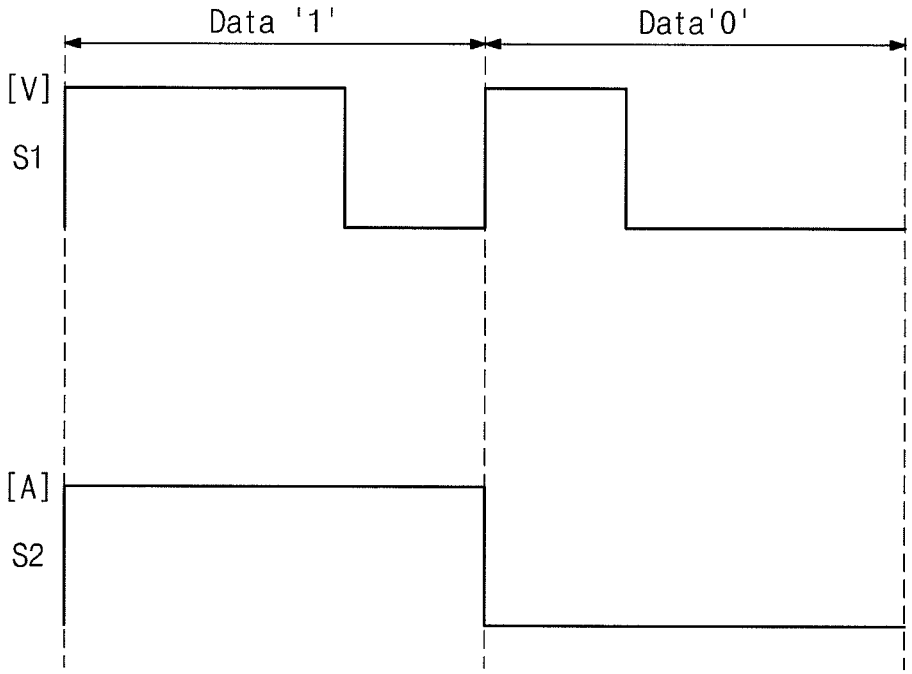
FIG. 3 is a timing diagram illustrating data signals S1 and S2 illustrated in FIG. 2.

FIG. 3 is a timing diagram illustrating the data signals S1 and S2 illustrated in FIG. 2.

Referring to FIGS. 1 through 3, the RF integrated circuit 20 transmits the S1 data signal transmitted from the integrated circuit card reader 30 to the integrated circuit card 10 through the single wire 22. The integrated circuit card 10 transmits the S2 data signal to the RF integrated circuit 20 through the single wire 22.

The S1 and S2 data signals are transmitted according to the SWP.

Data '1' and data '0' of the S1 data signal are determined by a duty cycle of the S1 data signal. As illustrated in FIG. 3, data '1' of the S1 data signal is determined when the S1 data signal has a high voltage level longer than it has a low voltage level. Data '0' of the S1 data signal is determined when the S1 data signal has a high voltage level shorter than it has a low voltage level.

Data '1' and data '0' of the S2 data signal are determined by a high state and a low state of an amount of current of the S2 data signal. If the S2 data signal is in a high state (e.g., a case where the amount of current is great), it represents data '1' and if the S1 data signal is in a low state (e.g., a case where the amount of current is small), it represents data '0'. A high state of the S2 data signal may be 600-1000 mA.

The integrated circuit card 10 controls the amount of current of the S2 data signal according to a transmission speed of the inputted S1 data signal. A method of controlling the amount of current of the S2 data signal is described further with reference to FIG. 4.

Figure 4:
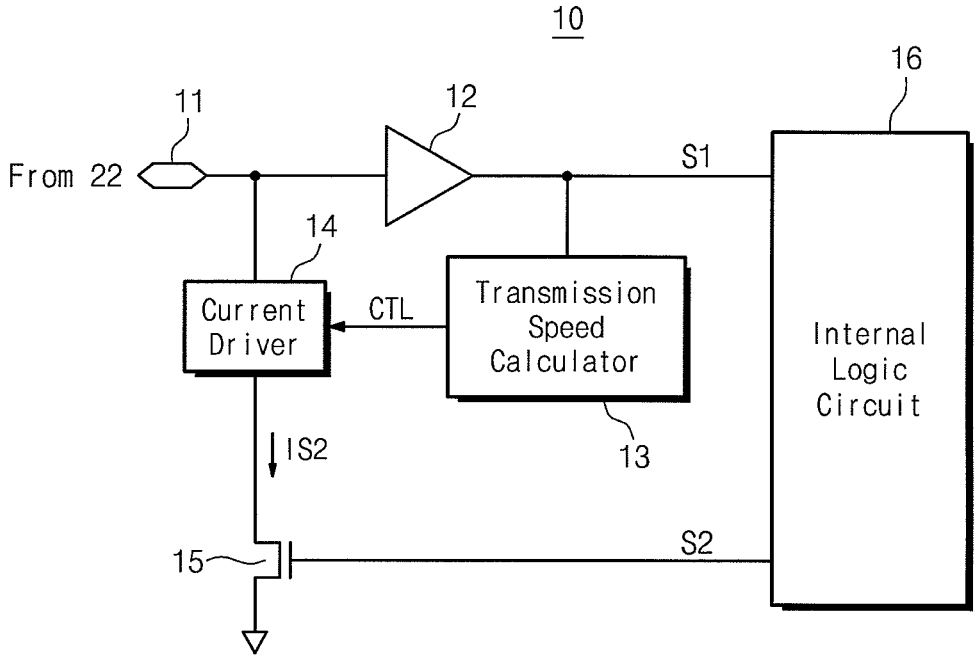
FIG. 4 is a block diagram illustrating the integrated circuit card illustrated in FIG. 2.

FIG. 4 is a block diagram illustrating the integrated circuit card 10 illustrated in FIG. 2.

Referring to FIGS. 1 through 4, the integrated circuit card 10 includes an input/output terminal 11, a buffer 12, a transmission speed calculator 13, a current driver 14, an NMOS transistor 15 and an internal logic circuit 16.

The input/output terminal 11 is connected to the pad (C6). The input/output terminal 11 is connected to the RF integrated circuit 20 by the single wire 22 connected to the pad (C6).

The RF integrated circuit 20 transmits the S1 data signal inputted through the input/output terminal 11 to the buffer 12. The buffer 12 transmits the S1 data signal to the transmission speed calculator 13 and the internal logic circuit 16.

The transmission speed calculator 13 judges a transmission speed of the transmitted S1 data signal to generate a control signal (CTL) for controlling the current driver 14. The current driver 14 responds to the control signal (CTL) of the transmission speed calculator 13 to control the amount of current flowing through the NMOS transistor 15.

Figure 5:
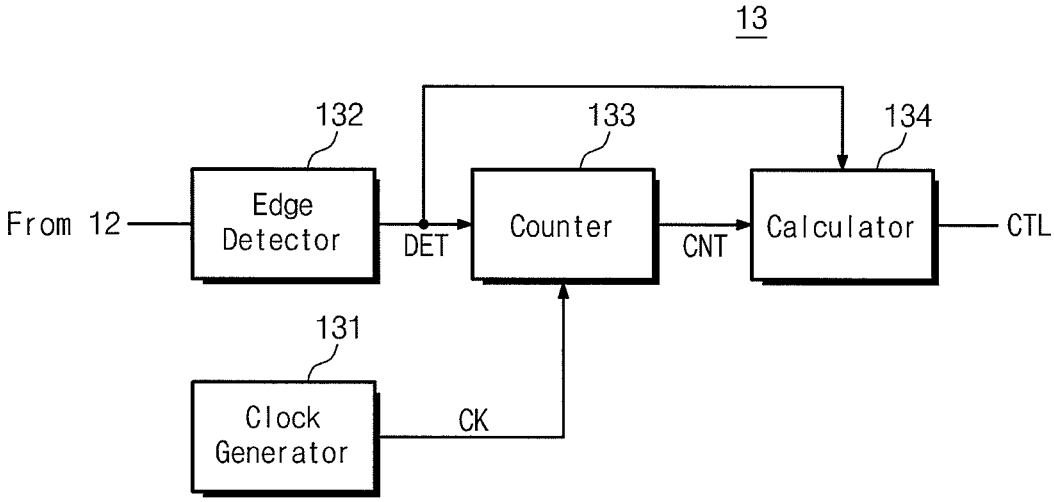
FIG. 5 is a block diagram illustrating a transmission speed calculator illustrated in FIG. 4.

The transmission speed calculator 13 is described further with reference to FIG. 5. In addition, the current driver 14 is described further with reference FIG. 7.

The internal logic circuit 16 transmits the S2 data signal to the NMOS transistor 15. The NMOS transistor 15 controls current applied from the current driver 14 according to the S2 data signal.

The RF integrated circuit 20 senses the amount of current flowing through the single wire 22 to judge a data value of the S2 data signal. For example, if the amount of current flowing through the single wire 22 is 600-1000 mA, the RF integrated circuit 20 judges that data '1' is transmitted from the integrated circuit card 10. In addition, if current is not flowing through the single wire 22, the RF integrated circuit 20 judges that data '0' is transmitted from the integrated circuit card 10.

If a transmission speed of the S1 data signal is 1.6 Mbps, the amount of current corresponding to the S2 data signal is controlled to be 1000 mA and if a transmission speed of the S1 data signal is 100 Kbps or less, the amount of current corresponding to the S2 data signal is controlled to be 600 mA, for example.

FIG. 5 is a block diagram illustrating the transmission speed calculator 13 illustrated in FIG. 4.

Referring to FIGS. 3 and 5, the transmission speed calculator 13 in accordance with an exemplary embodiment of the inventive concept includes a clock generator 131, an edge detector 132, a counter 133 and a calculator 134.

The clock generator 131 generates a clock signal (CK). The edge detector 132 detects an edge of the S1 data signal transmitted from the buffer 12 to generate an edge detecting signal (DET).

The counter 133 receives the edge detecting signal (DET) transmitted from the edge detector 132 and the clock signal (CK) transmitted from the clock generator 131 to output a count signal (CNT).

Figure 7:
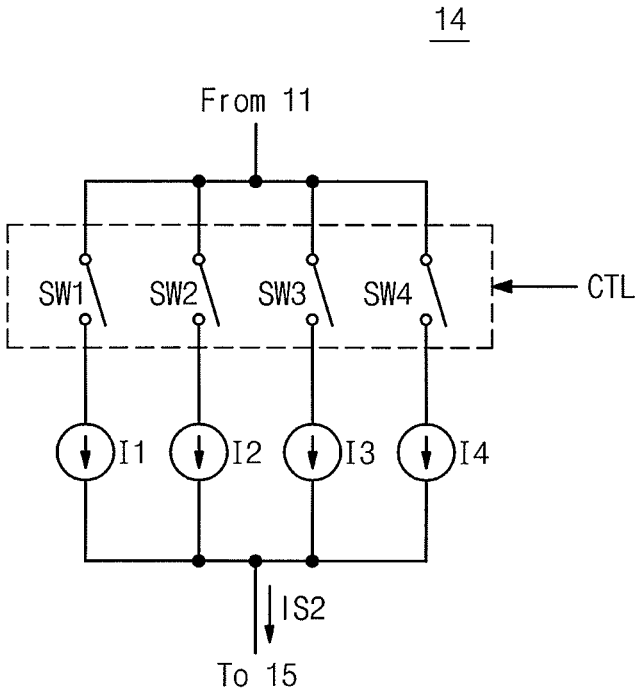
FIG. 7 is a block diagram illustrating a current driver illustrated in FIG. 4.

An operation of the counter 133 in accordance with an exemplary embodiment of the inventive concept is described further with reference to FIG. 7.

The calculator 134 receives the counter signal (CNT) transmitted from the counter 133 to generate the control signal (CTL) controlling the current driver 14. The control signal (CTL) is comprised of a plurality of bits to control a plurality of switches of the current driver 14.

Figure 6:
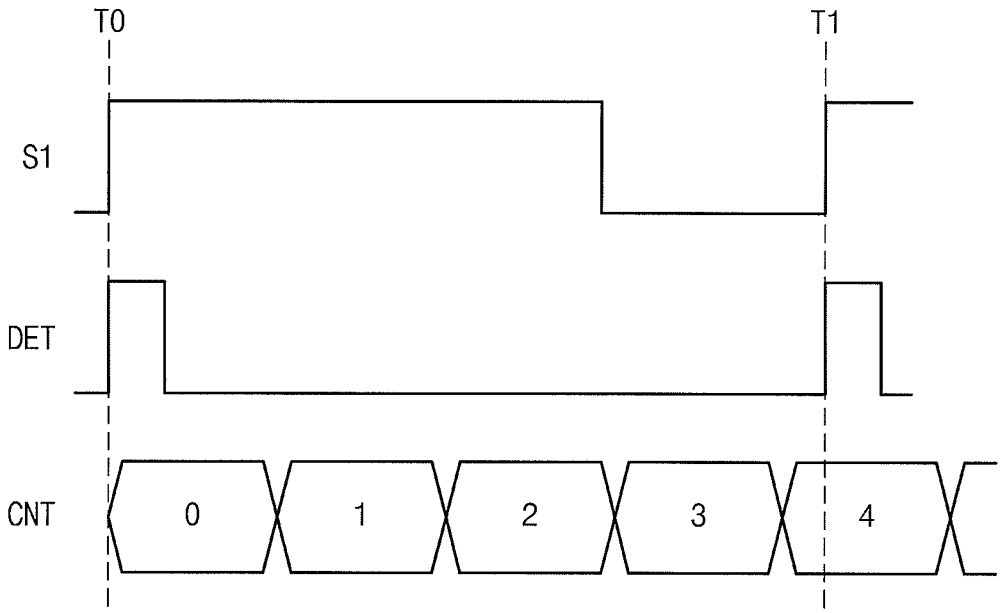
FIG. 6 is a timing diagram illustrating an operation of a counter illustrated in FIG. 5.

FIG. 6 is a timing diagram illustrating an operation of the counter 133 illustrated in FIG. 5.

Referring to FIGS. 5 and 6, at T0 time, the edge detector 132 detects an edge of the S1 data signal to transmit a first edge detecting signal (DET) to the counter 133. The counter 133 begins to count the cycles of the clock signal (CK) on the basis of the first edge detecting signal (DET) transmitted from the edge detector 132.

At T1 time, the edge detector 132 detects a next edge of the S1 data signal to transmit a second edge detecting signal (DET) to the counter 133. The counter 133 ends the counting on the basis of the second edge detecting signal (DET) transmitted from the edge detector 132. The calculator 134 receives the count signal (CNT) (e.g., the number of clock cycles counted between T0 and T1) transmitted from the counter 133 to generate the control signal (CTL) for controlling the current driver 14.

FIG. 7 is a block diagram illustrating the current driver 14 illustrated in FIG. 4.

Referring to FIGS. 4 and 7, the current driver 14 includes first through fourth switches (SW1-SW4) and first through fourth current sources (I1 through I4). The first switch (SW1) is serially connected between the input/output terminal 11 and the first current source (I1). The first current source (I1) is serially connected between the first switch (SW1) and the NMOS transistor 15. The second switch (SW2) is serially connected between the input/output terminal 11 and the second current source (I2). The second current source (I2) is serially connected between the second switch (SW2) and the NMOS transistor 15. The third switch (SW3) is serially connected between the input/output terminal 11 and the third current source (I3). The third current source (I3) is serially connected between the third switch (SW3) and the NMOS transistor 15. The fourth switch (SW4) is serially connected between the input/output terminal 11 and the fourth current source (I4). The fourth current source (I4) is serially connected between the fourth switch (SW4) and the NMOS transistor 15.

The first through fourth switches (SW1-SW4) are switched by the control signal (CTL) transmitted from the transmission speed calculator 13.

The control signal (CTL) is expressed by a plurality of bits. For example, when the control signal (CTL) is '1111', the first through fourth switches (SW1-SW4) are turned-on. In addition, when the control signal (CTL) is '1000', only the first switch (SW1) is turned-on and the second through fourth switches (SW2-SW4) are turned-off.

The integrated circuit card in accordance with an exemplary embodiment of the inventive concept senses speed of a signal transmitted according to the SWP. If a transmission speed of an input data signal is high, the integrated circuit card increases the amount of current corresponding to output data and, if not, it reduces the amount of current corresponding to the output data. Thus, the integrated circuit card according to an exemplary embodiment of the inventive concept can stably operate during a high speed data transfer operation and reduce current consumption by changing the amount of current of data output from the integrated circuit card according to a transmission speed of data input to the integrated circuit card.

The integrated circuit card in accordance with an exemplary embodiment of the inventive concept may be applied to a subscriber identification module (SIM) card, a mobile system and a radio frequency identification (RFID) reader. The SIM card, the mobile system and the RFID reader are described with reference to FIGS. 8 through 10.

Figure 8:
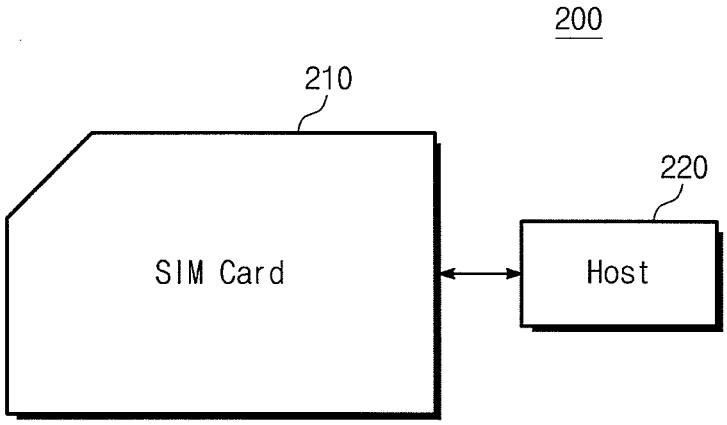
FIG. 8 is a block diagram illustrating a subscriber identification module (SIM) card in accordance with an exemplary embodiment of the inventive concept and a host connected to the SIM card.

FIG. 8 is a block diagram illustrating a SIM card in accordance with an exemplary embodiment of the inventive concept and a host connected to the SIM card.

Referring to FIG. 8, a SIM card 210 may include the integrated circuit card 10 and the RF integrated circuit 20 or include only the integrated circuit card 10.

The SIM card 210 is configured to communicate with a host 220 using a wire. If the SIM card 210 includes the RF integrated circuit 20, it is configured to wirelessly communicate with the host 220.

For example, the SIM card 210 may be a smart card fitted with a flash memory device. In other words, the SIM card 210 may be a card satisfying any industrial standard to use an electronic device such as a smart phone, a mobile phone of global system for mobile communications (GSM) technology and a mobile phone supporting a third generation communication standard.

Figure 9:
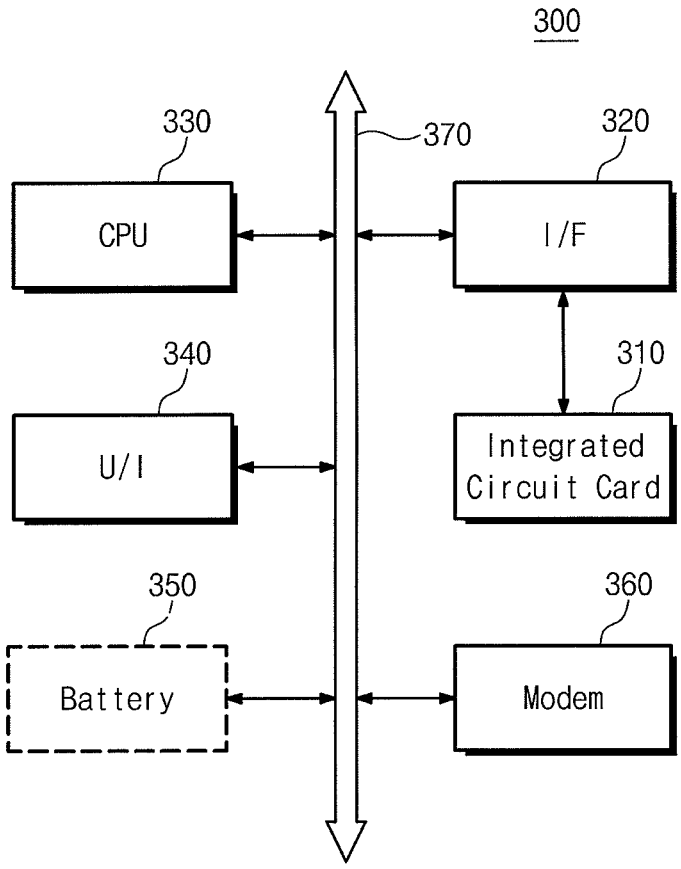
FIG. 9 is a block diagram illustrating a mobile system in accordance with an exemplary embodiment of the inventive concept.

FIG. 9 is a block diagram illustrating a mobile system including an integrated circuit card in accordance with an exemplary embodiment of the inventive concept.

Referring to FIG. 9, a mobile system 300 in accordance with an exemplary embodiment of the inventive concept includes an integrated circuit card 310, an interface 320, a central processing unit 330 connected to a system bus 370, a user interface 340, a modem 360 such as a baseband chipset and a battery 350.

The integrated circuit card 310 may include the integrated circuit card 10 and the RF integrated circuit 20 or include only the integrated circuit card 10. In addition, the integrated circuit card 310 may be embodied by the SIM card illustrated in FIG. 8.

The interface 320 may function so that the central processing unit 330 can access the integrated circuit card 310 through the system bus 370. The user interface 340 may provide a user interface for driving a program with which a user controls the mobile system 300.

The mobile system 300 may include the battery 350 for supplying an operation voltage of a computing system. The battery 350 may be built in the mobile system 300 or may be attached to and detached from the mobile system 300.

Although not illustrated, the mobile system 300 may further include an application chipset, an image processor, e.g., a contact image sensor (CIS), a mobile dynamic random access memory (DRAM) or the like.

Figure 10:
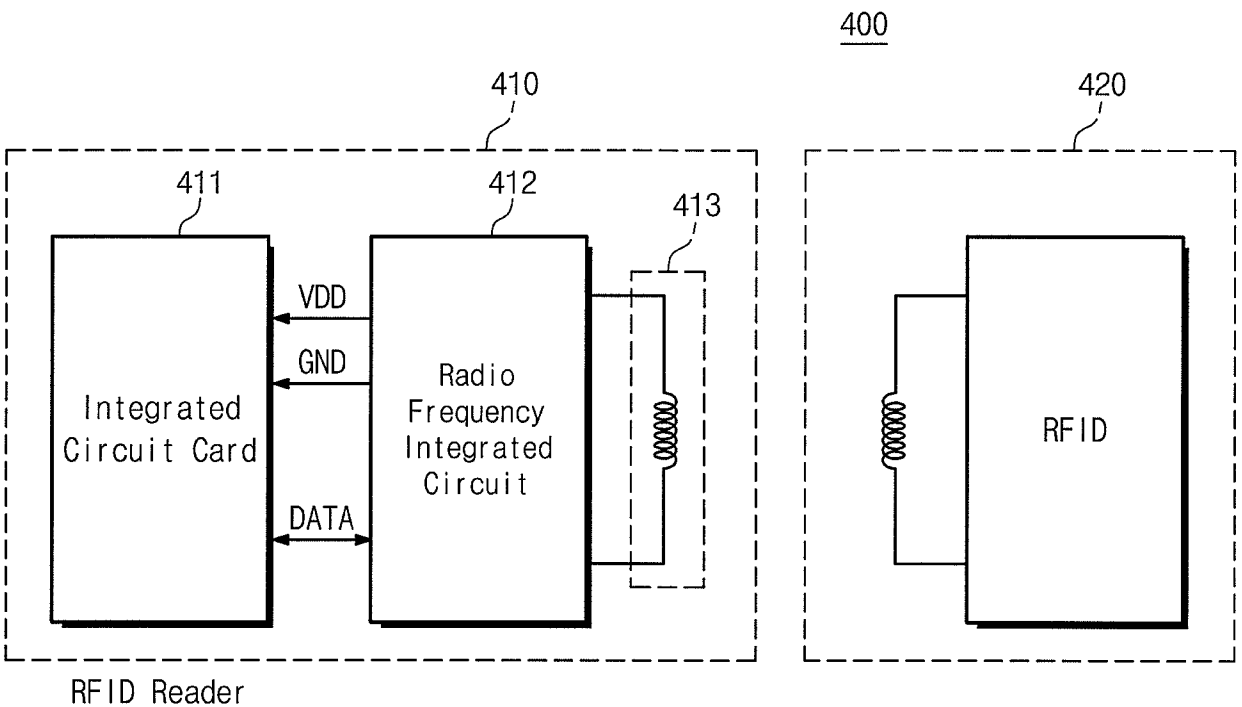
FIG. 10 is a block diagram illustrating a radio frequency identification (RFID) reader and an RFID tag in accordance with an exemplary embodiment of the inventive concept.

FIG. 10 is a block diagram illustrating an RFID reader and an RFID tag in accordance with an exemplary embodiment of the inventive concept.

Referring to FIG. 10, an RFID reader 410 in accordance with an exemplary embodiment of the inventive concept includes an integrated circuit card 411, a RF integrated circuit 412 and an antenna 413.

The integrated circuit card 411, the RF integrated circuit 412 and the antenna 413 may be embodied with substantially the same construction as the integrated circuit card 10, the RF integrated circuit 20 and the antenna 21. The integrated circuit card 411 reads data from an RFID tag 420 through the RF integrated circuit 412.

While the inventive concept has been particularly shown and described with reference to exemplary embodiments thereof, it will be understood by those of ordinary skill in the art that various changes in form and details may be made therein without departing from the spirit and scope of the inventive concept as defined by the following claims.

What is claimed is:

1. An integrated circuit card system, comprising:

a radio frequency (RF) integrated circuit configured to wirelessly communicate with an integrated circuit card reader; and an integrated circuit card connected to the RF integrated circuit by a single wire, the integrated circuit card configured to change an amount of current of a data signal output from the integrated circuit card according to a transmission speed of a data signal input to the integrated circuit card from the RE integrated circuit, wherein the integrated circuit card comprises:

a transmission speed calculator configured to determine the transmission speed of the input data signal;

a current driver configured to provide the current corresponding to the output data signal;

a transistor connected between the current driver and a ground voltage, the transistor configured to be controlled by the output data signal, wherein the transmission speed calculator is configured to control the current provided by the current driver according to the transmission speed of the input data signal.

2. The integrated circuit card system of claim 1, wherein the transmission speed calculator comprises:

a clock generator configured to generate a clock;

an edge detector configured to detect first and second edges of the input data signal, the second edge corresponding to the same transition. as the first edge;

a counter configured to begin counting a cycle of the clock in response to the detection of the first edge, and end the dock cycle counting in response to the detection of the second edge and output the count; and a calculator configured to generate a signal to control the current provided by the current driver according to the count.

3. The integrated circuit card system of claim 2, wherein the integrated circuit card further comprises a plurality of pads, wherein at least one of the pads is connected to the RF integrated circuit by the single wire.

4. The integrated circuit card system of claim 3, wherein the plurality of pads comprises eight pads.

5. The integrated circuit card system of claim 2, wherein the current driver comprises a plurality of switches, each switch serially connected between an input terminal of the integrated circuit card and a respective current source, the current sources connected to an output terminal of the integrated circuit card, and the switches configured to be activated in response to the signal generated by the calculator.

6. The integrated circuit card system of claim 2, wherein the first and second edges of the input data signal comprise rising edges of the input data signal or falling edges of the input data signal.

7. The integrated circuit card system of claim 1, wherein the input signal and the output signal are transmitted between the RF integrated circuit and the integrated circuit card according to a single wire protocol.

8. The integrated circuit card system of claim 1, wherein the RF integrated circuit comprises an antenna for wirelessly communicating with the integrated circuit card reader.

9. The integrated circuit card system of claim 1, wherein the input data signal comprises data '1' in response to a high voltage level of the input data signal being longer than a low voltage level of the input data signal during a period of the input data signal.

10. The integrated circuit card system of claim 1, wherein the input data signal comprises data '0' in response to a high voltage level of the input data signal being shorter than a low voltage level of the input data signal during a period of the input data signal.

11. The integrated circuit card system of claim 1, wherein the output data signal comprises data '1' in response to the amount of current being equal to or greater than a predetermined value,

12. The integrated circuit card system of claim 1, wherein the output data signal comprises data '0' in response to the amount of current being less than a predetermined value.

13. The integrated circuit card system of claim 1, wherein the integrated circuit card is included in a subscriber identification module (SIM) card.

14. The integrated circuit card system of claim 1, wherein the RF integrated circuit is included in a SIM card.

15. The integrated circuit card system of claim 1, wherein the RF integrated circuit and the integrated circuit card are part of a mobile system.

* * * * *